United States Patent [19]

Bijttebier et al.

[11] 4,437,655

[45] Mar. 20, 1984

[54] PROCESS AND APPARATUS FOR SEPARATING FLEXIBLE SHEETS FROM A STACK

[75] Inventors: Gaspar A. H. Bijttebier, Grote Heerweg 64, B-8749 Waregem-Beveren; Jozef Vangheluwe, Roeselare, both of Belgium

[73] Assignee: Gaspar A. H. Bijttebier, Waregem-Beveren, Belgium

[21] Appl. No.: 260,988

[22] Filed: May 6, 1981

[30] Foreign Application Priority Data

May 12, 1980 [BE] Belgium ..... 1/9815

[51] Int. Cl.[3] ..... B65H 3/22

[52] U.S. Cl. ..... 271/3.1; 271/18.3; 271/168

[58] Field of Search ..... 271/18.3, 168, 3.1, 271/8 R, 145

[56] References Cited

U.S. PATENT DOCUMENTS

| | | | |
|---|---|---|---|
| 2,554,821 | 5/1951 | Garfunkel | 271/168 X |
| 3,738,645 | 6/1973 | Gray | 271/168 X |
| 3,981,495 | 9/1976 | Bijttebier | 271/18.3 |
| 4,008,888 | 2/1977 | Vinciguerra | 271/18.3 |
| 4,348,018 | 9/1982 | Bijttebier | 271/18.3 X |

*Primary Examiner*—Richard A. Schacher

*Attorney, Agent, or Firm*—Shlesinger, Arkwright, Garvey & Fado

[57] ABSTRACT

The invention relates to a process and apparatus for separating flexible sheets from a stack wherein the stack is locally compressed and pierced and stack holders are fitted in the holes formed extending through the entire thickness of the stack. The piercing device caan be located inside the frame of the actual separating device or in a second frame linked to the first frame, which frame is then provided with transporting chains to introduce the supporting platforms for the stacks into said frame, and to remove them therefrom after the sheets have been separated from the stack. The apparatus also includes an improved pick-up head wherein a stop for the pricking element is mounted between the pressure shoes.

18 Claims, 6 Drawing Figures

1
3
8
7
32
6
66
47
24
31
15
16
19
28
22
43
40
14
39
55
30
37
13
37
4
17
17
41
18
18
13
5
2
24
14
49
35
48
36
11
29
9
54
21
20
51
10
23
12
50
35
33

PROCESS AND APPARATUS FOR SEPARATING FLEXIBLE SHEETS FROM A STACK

The invention relates to a process and apparatus for separating flexible sheets, such as textiles, from a stack. It covers means and measures for feeding the sheet stacks to a processing machine, as well as, in combination therewith, the error free separation of the sheets from the stacks fed into a separating machine.

BACKGROUND OF THE INVENTION

For some time now in the ready-made clothing industry, it has been found desirable to feed cut textile sheets automatically to processing units, e.g. stitching machines. It is usual in such processes for the size cut sheets to be separated one by one from sheet stacks and slid in correct alignment and orientation into the processing unit, e.g. the stitching heads. Applicant has developed apparatuses which separate the sheets without error and subsequently transport them in correct position to the processing unit. Descriptions of such separating and processing methods and automatic feeding apparatuses for flexible sheets are known from U.S. Pat. No. 3,981,495 and from U.S. Pat. No. 4,348,018. These apparatuses comprise a table located under a number of pick-up heads, on which table the sheet stacks are deposited manually against suitable stops or into a receptacle. Each time a sheet stack has been processed by the separating device, a new stack must be manually and accurately fed into the machine; quite often this is a time-consuming procedure requiring extra attention from the machine-operators. Moreover, whenever sheet stacks with other shapes or sizes must be processed, it is necessary to change the moulds or adjust the stops for the stack side edges. Sometimes, in case of thick stacks, it is also difficult to maintain the square alignment of the stacks when they are repeatedly compressed by the pick-up heads near one edge only to spring back upwards when the sheets are being separated. Indeed, in this case, they tend to incline progressively towards this pick-up edge and sometimes even to curl inwardly at their upper sides thus getting stuck against the vertical stops or mould plates near this pick-up edge so that error free separation is impeded. This difficulty mainly arises with stacks of considerable dimensions, such as e.g. shirt backs, or very small dimensions, such as e.g. belts.

The invention now provides a process and apparatus which eliminate this manual operation and the associated drawbacks, such as additional workload for the operator and inaccurate processing. At the same time, the measures according to the invention quite surprisingly offer the separation process increased reliability, particularly with regard to the mutual separation between the stack and the sheet to be removed.

BRIEF DESCRIPTION OF THE INVENTION

According to the invention, the stack to be subsequently subjected to sheet separation is compressed in at least one location and pierced right through the stack surface and in the holes obtained stack holders are fitted which extend at least through the entire thickness of the stack and which preferably project from either side of the stack. The result of this is that the stack keeps its square alignment throughout the sheet separation process. Subsequently, during the successive separating cycles, applied to the stack thus clamped on the stack holders, the sheets are separated and lifted from the stack upper surface by means of suitable separating elements engaging the top sheet in at least one limited area.

The piercing operation may take place in a separate piercing device located outside the actual separating apparatus. The cutting table, where the sheet stacks are cut out of cloth piles, may be provided with a piercing device, provided that adapted cutting means are used. The stackholders may for example be mounted in a cutting press or punching device. The combination of the cutting and piercing operations in one device may also be advantageous from the point of view of accuracy of the piercing operation. The stack thus pierced and clamped on the stack holders is then slid into a suitable position on the table under the pick-up heads of the separating apparatus, after which the stack holders are removed from the separation zone. Preferably, an unpierced stack will be deposited on a supporting platform (for example with at least one edge slid against suitable positioning stops in said platform with that edge compressed after positioning and vertically pierced by at least one stack holder fixed to the platform. If a separate piercing device is used then this supporting platform, together with the stack damped on the stack holders, will be slid into the desired position under the pick-up heads in the separating apparatus (in case there is no fixed separating table in the separating apparatus). If the stack clamped on the stack holders is brought directly from the cutting table, it may obviously be deposited upon such a supporting platform for further processing in the separating apparatus.

As an alternative, the stack may also be pierced while it is in the actual separating apparatus under the separating means. After the separation of the sheets, the upwardly projecting points of the stack holders are removed with the supporting platform from the separation zone, for example by lowering the whiole unit, so that a new, (for example already compressed stack) can be deposited on the platform under the separating elements.

Generally the stack holders are sturdy needles and the limited where separation is intiated on the stack surface is preferably located in the vicinity of a needle point projecting from the stack.

Although for the process according to the invention the choice of suitable separating elements is in principle quite wide, it was found that the use of the separating processes and pick-up heads described in German Patent No. 2.449.273 or in Belgian patent No. 846.649 of Applicant offered very good results. Preferably, use will be made of the pick-up heads described in said patents which comprise pairs of pressure shoes exerting at their undersides substantially parallel strips of pressure on the stack when being pressed down on it. Subsequently, between the formed pressure strips, a number of sharp projections with preset projection lengths are pricked obliquely into the stack and the successively pricked sheets are partially lifted from the stack in the area where pricked as soon as the pressure under the pick-up head is released.

If the process according to the abovementioned patents is applied, wherein the stack is compressed under pick-up heads acting in pairs, then the pricked sheets are slightly tightened or stretched between these co-acting heads to stimulate the separation of the sheets when the pressure on the stack is released.

When, however, stacks of sheets of small dimensions or of poorly stretchable material must be processed, so as for example breast pockets on shirts, then for this purpose it is preferable to use specially adapted pick-up heads which comprise at their undersides a member exerting a transverse strip of pressure on the stack extending substantially at right angles between the parallel pressure strips. This member then forms a stop against which the sharp projections press obliquely with the pricked sheet before the sheet is lifted. Preferably in this case, the pressure on the stack in said transverse direction will be exerted slightly sooner than in the parallel pressure strips.

The separating process under the application of the separating elements and measures described above can thus, in principle, take place according to three methods. One can use no more than one pick-up head which, at its underside, comprises a member exerting the stripwise transverse pressure, and hence compresses the stack in but one bounded zone as described above. On the other hand, one may apply a number of such pick-up heads in different locations—for example over a number of corners—of the stack and lift the sheet simultaneously in several limited areas. It is also possible to apply one or more of these pick-up heads in combination with a number of the pick-up heads described in Applicant's aforesaid patents. In this last case, the various mutually co-acting pick-up heads (or pick-up head pairs) will obviously be oriented in such a way with respect to each other as to permit an efficient stretching operation on the sheet zone between the co-acting heads.

The invention also relates to apparatuses for carrying out the aforesaid processes. A preferred embodiment and its operation will now be described in greater detail with reference to the adjoined drawings. Additional characteristics and advantages of the invention will thereby be clarified.

DETAILED DESCRIPTION

Figure 1:
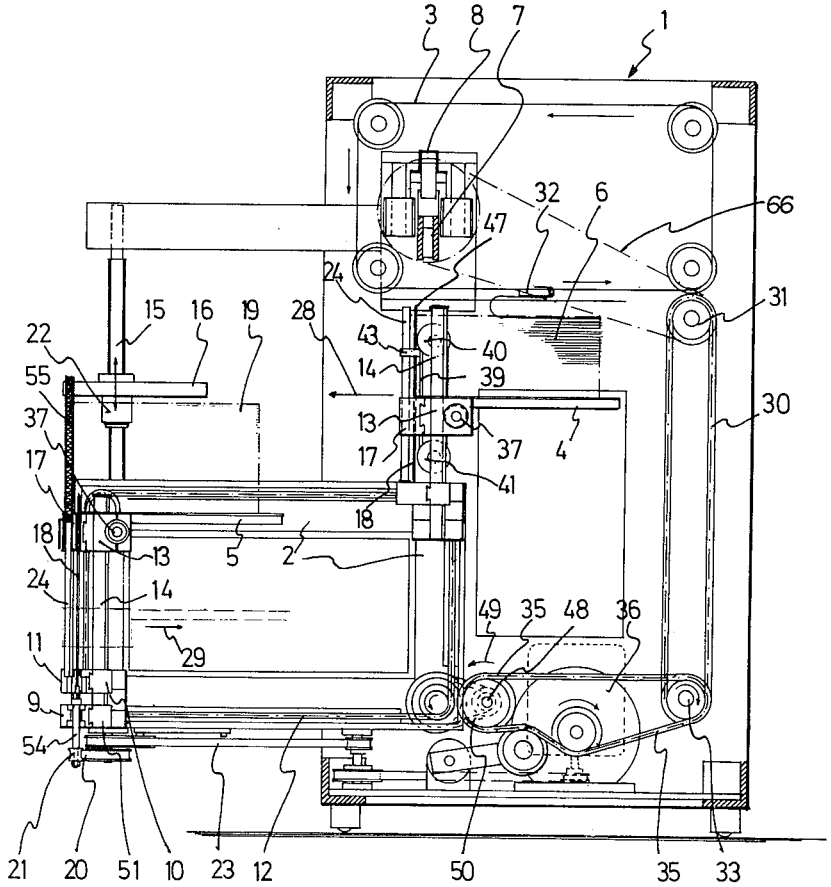
FIG. 1 is a side elevational view of the separating apparatus with a built-in piercing and feeding device for the sheet stack.
Figure 2:
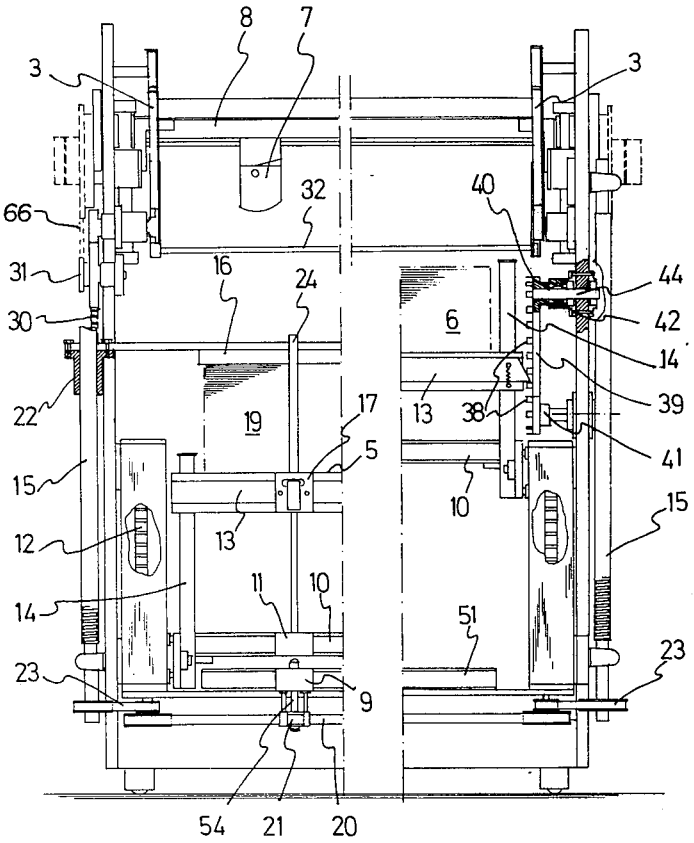
FIG. 2 is a front view of the separating apparatus.

The separating apparatus according to FIGS. 1 and 2 comprises a first framework 1 in which are mounted at least one up-and-down movable pick-up head 7 and beam means 8 for lowering these pick-up heads on at least one upper edge of a stack 6 of flexible sheets, as well as conveyor means 3, for example circulating chains, to which rod-shaped clamping means 32 are attached for the successive removal of the individual pricked sheets from the stack 6. A framework 1 of this type with pick-up heads 7, the specific rod-shaped removal means 32, and an up-and-down movable supporting platform 4 for the sheet stack are extensively described in U.S. Pat. No. 4,348,018 of Applicant together with a mechanism for conveying the sheets individually to subsequent processing units.

A characteristic of the apparatus according to the invention is that said supporting platform 4 is connected to conveyor means, e.g. chains 12, circulating in the sides of a second framework 2 and serving for alternately introducing the platform 4 loaded with a full stack 6 into the first framework 1 and removing the supporting platform 4, when empty, out of the framework 1. Moreover, a second supporting platform 5 is connected in the second framework 2 to conveyor chains 12 and this platform 5 is mounted in such a way on the chain course that it is located at the piercing heads 9, while the platform 4 is located under the pick-up heads 7. Obviously, the piercing heads 9 are part of the piercing device described hereafter for inserting the stack holders 18 into the stack 19 on the platform 5.

The stack holders 18 are mounted adjacent bars 13 located adjacent an edge of the supporting platforms. The stack holders 18, having points 47 pointed in an upward direction, extend through stack holder clamps 17 and may be moved vertically. In their turn, these clamps 17 are horizontally movable on the edge bars 13 along the edges of the supporting platforms. These clamps may also include abutment rods 24 which function as stops for retaining the stack edge. The lower ends of the stack holders 18 are rotatably mounted in a base 11 which is connected to a transverse bar 10 upon which the base 11 adjustably positionable in a lateral (horizontal) direction in alignment with the stack holder clamps 17. This transverse bar 10 is fixed at both its ends to the conveyor chains 12. In its turn, the supporting platform 4 is, preferably near the same place as bar 10, connected to the chains 12 via the edge bar 13 and vertical rack rails 14.

Apart from the piercing head 9 actuated by belt 20 and belt disc 21, the piercing device also comprises the stack holders 18, which may function as the actual piercing means and whose lower ends can fittingly engage with the piercing head 9 and so be driven in rotation. The stack holders 18 are preferably long needles whose upper-ends 47 are slightly thinner than the needle shanks. The piercing device further comprises a pressure plate 16 located above the stack lying on platform 5, and which near its edges engages with the jacks 15 by means of nuts 22 in order to be driven in rotation via chain transmissions 23. The supporting platform 5 which is movable up and down on rack rails 14 forms the counter-pressure plate for stack 19 in the piercing device. The sprocket wheels 37 which engage with the rack rails 14 are mounted on a shaft 25. Via a freewheel clutch 26 with brake, which engages with rack rail 27 (see FIG. 3) is provided that the platform 5 is subjected to some resistance when sliding downward, but not when moving upward.

Figure 3:
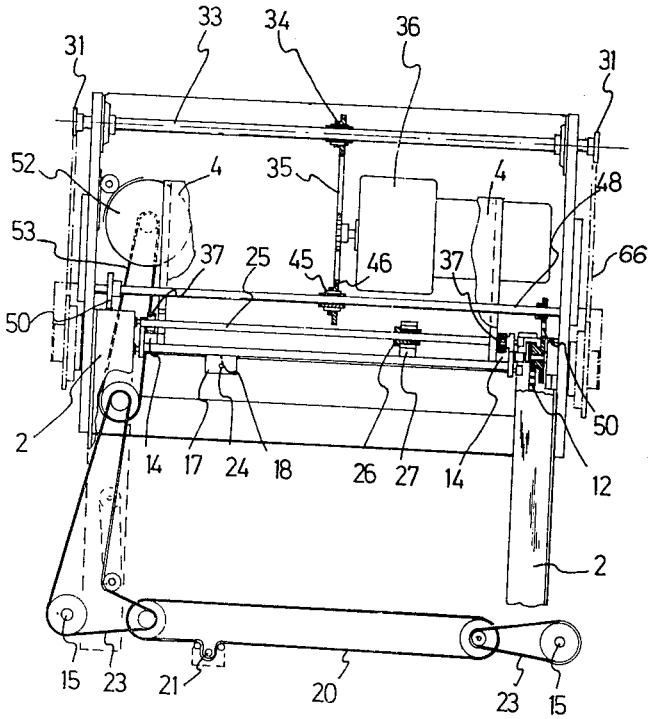
FIG. 3 is a schematic view of the mechanism for actuating a number of components.

Further details of the device and their interactions, such as the driving circuits for the parts in frame 1, and in frame 2, will now be described by a discussion of the operation of the device, more specifically the methods of inserting and removing the supporting platforms into and out of frame 1, with reference to the FIGS. 1, 2 and 3.

Let use imagine that a full stack has been deposited on platform 4. For the separation of the sheets individually from the stack, the stack and the pick-up heads 7 are, in turns, moved towards and away from each other by suitable mechanical driving means. In the preferred embodiment according to the invention, this is achieved by means of a chain transmission 30 and the chain transmission 66. The chain transmission 30 simultaneously drives the circulating chain 3 with the removal means 32 thereon by means of a coupling with driving gear 31 are lowered with a substantially fixed stroke length and with a pressure of approximately 40 kg per head onto the stack surface. The transmission 30 is driven, via shaft 33 and sprocket wheel 34 (FIG. 3) through a freewheel clutch, in the indicated direction by the chain 35 which is connected to the main motor 36 of the apparatus. The platform 4 is progressively moved upwards as sheets are being removed. However, the stack holders 18 and the abutment rods 24 do not move upwards with the platform, their lower ends being held in the base 11 fixed to transverse bar 10. Thus, as the stack becomes thinner, the stack holder 18 is progressively pulled out of the stack at the bottom thereof.

The use of long needles as stack holders 18, having upper ends slightly thinner than their shanks, results in the sheet edges sliding smoothly over these ends when being lifted by the pick-up heads 7, while the remainder of the stack 6 stays firmly on the thicker needle shank. The shank may possess a somewhat rough surface. The stack holder 18 may also comprise a thin raised point 47 which can easily and resiliently bend forward and backward or which has a curved shape. It may also suffice in some cases to provide a strong textile filament or yarn with rough surface as stack holder 18 while the stack is compressed. During the separating process this filament also keeps the stack compressed and upright and is afterwards progressively pulled out of the stack at the bottom when the supporting platform 4 is lifted.

The progressive upward movement of the platform 4 can for example be achieved by the engagement of the ends of edge bar 13 between blocks 38 fixed to a carrier chain 39 which runs over sprocket wheels 40 and 41 in both sides of the apparatus. The sprocket wheel 40 via a freewheel clutch 42 is turned in steps so that the blocks 38 and the ends of edge bar 13 resting on them are raised progressively. The freewheel clutch 42 is provided with an arm 43 which in its turn is connected to the up-and-down movement of the pick-up heads 7. This connection has not been illustrated. Each time the arm 43 is rotated upwards about shaft 44 it takes the chain 39 and the blocks 38 carrying edge bar 13 along. The chains stay stationary when the arm 43 is lowered.

As soon as the stack 6 has been fully removed, the platform 4 reaches its top position so shutting off a contact or giving in another manner—for example by means of a photo cell—a signal to the main motor 36 to reverse its direction of rotation. As a result the freewheel clutch between the sprocket wheel 34 and the shaft 33 is actuated with the result that the sheet separating section is switched off. At the same time, however, the freewheel clutch 45 acting in the reverse direction and driving the sprocket wheel 46 starts to rotate with the chain 35 in the direction indicated by arrow 49. As a result the shaft 48 drives, via the chain transmission 50, the conveyor chain 12 carrying the platforms 4 and 5. The platform 4 is thus moved out of the sheet separation zone in the direction of arrow 28, while the platform 5 carrying the full stack 19 is moved towards the frame 1 according to the arrow 29. The chain continues its course till platform 5, after its horizontal and subsequent vertical translation guided by the chains 12, reaches the position formerly occupied by the platform 4. This platform then again gives a signal (for example by means of a photo cell) so that the direction of rotation of motor 36 is reversed. The chain 35 again drives the shaft 33 and hence also the sheet separating apparatus, and the freewheel clutch 45 provides that the chain transmission 50 and the conveyor chain 12 are held still by the shaft 48.

It is evident that each time that a new stack must be placed in position and pierced by stack holders 18 on platform 5 before the stack 6 is fully removed from beneath the pick-up heads 7 on the preceding platform 4. This piercing operation takes place as follows. The cut sheet stack 19 to be processed is deposited with its edge against the abutment rods 24 over the needle points 47 on platform 5. (For this purpose, the abutment rods 24 are equipped with an upward spring-loaded extension tube 55.) The lateral positions of the stack holder clamps 17 on edge bar 13 and of bases 11 on transverse bar 10 are preferably selected in such a way that the projecting needle points 47 will be in the vicinity of the separation zone in frame 1. Now, on the cross bar 51, the piercing head 9 is moved in such a way as to face the lower end of the stack holder 18. The machine operator now starts the motor 52 (see FIG. 3), which drives, by means of sprocket belt or chain transmissions 53, 23 and 20, the jacks 15 mounted at both sides of frame 2 and the belt disc 21 of the piercing head 9. In this way, the pressure plate 16 is lowered via nuts 22 on the jacks 15 and compresses the stack 19 between plate 16 and platform 5 which, under the influence of an adjustable brake clutch on sprocket wheels 26 engaging with rack rails 27 descends slowly down to the level shown in out line. In the meantime, the stack holder 18 pierces through the stack and as soon as its point 47 projects with the desired length from the top surface (and plate 16) the piercing device is switched off and the direction of rotation of motor 52 is reversed, whereby the pressure plate 16 on the jacks 15 is again screwed upwards. A freewheel clutch between the belt disc 21 and piercing head shaft 54 prevents the stack holder from rotating in reverse direction. The motor 52 is switched off as soon as the pressure plate reaches its top position again.

The use of these stack holder needles 18 offers a number of further advantages. For piercing the full stack in the piercing device, the stack is clamped in this device and compressed between pressure plate 16 and platform 5. The thickness of the stack pricked on these needles 18 and thus held on the needle shanks is smaller than that of an unpierced stack in which the sheets are deposited one on the other rather loosely. Also the vertical distance through which the stack springs back after compression under the pick-up heads 7 becomes shorter because the sheets are held on the needle shanks. The result is that the required stroke (the vertical distance to be covered) for the pick-up heads 7 to compress the stack during their downward movement will be considerably shorter than for an unpierced stack. These shorter stroke lengths hence result in shorter separating cycle times. Moreover, these shorter vertical stroke lengths through which a pricked sheet is lifted will produce less tensile stresses in the lifted sheet plane (which tension during the rolling-off of the sheet shifts from the lifted sheet edge to the progressively moving separation line between the upper stack surface and the lifted sheet.) This counteracts any tendency of the lifted sheet to skew the top of the stack. Finally, the needles constitute an important aid in keeping the stack aligned and square during the separating process, namely during the alternate applying and releasing of the pressure on the edge of the top sheet.

Figure 4:
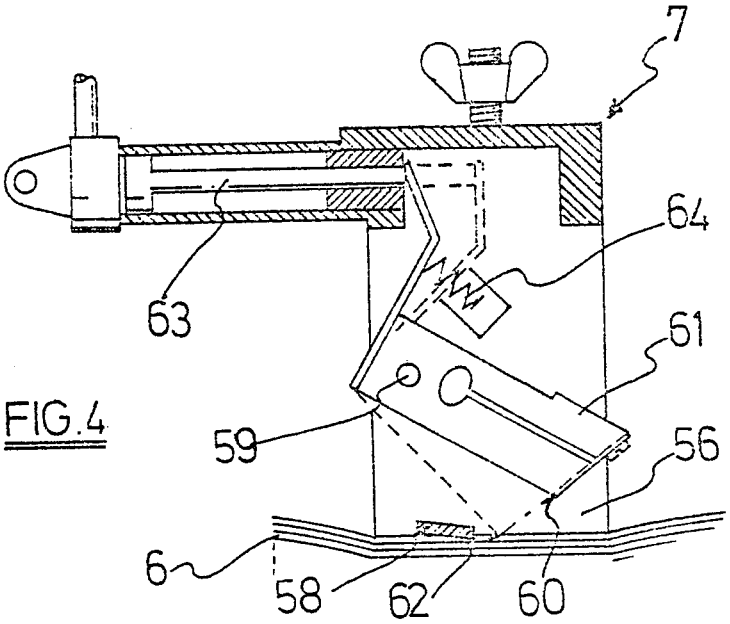
FIG. 4 is a view of the new pick-up head.

FIG. 4 shows an embodiment of a new pick-up head with which a strip of transverse pressure is formed on the stack between parallel pressure shoes. The specific pick-up head which represents an inventive aspect of the apparatus essentially comprises a massive holder fixed to beam 8 which carries two parallel pressure shoes 56, 57 which are mutually connected at their bases by a transverse member 58. This member preferably is located 1 to 2 mm under the level of the bottom edge of the pressure shoes. Rotatably mounted by means of bearings on the horizontal shaft 59 between pressure shoes 56 and 57 is a pricking element 61 provided with projections 60 at its base. The pricking element 61 is adapted to rotate from a retracted position into an operating position where the projection ends are stopped by the edge 62 of the member 58 the sheet to be removed held between them. The projection length of the projections 60 from the pricking element 61 is adjustable and the rotating movement of the pricking element 61 towards and from its operating position (pricking position) is regulated by known means: pneumatic pressure applied by pin 63 and counterpressure applied by spring 64.

Figure 5:
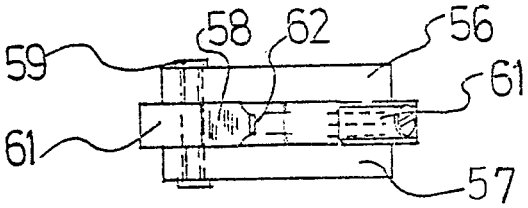
FIG. 5 is a view of the underside of this pick-up head.

The underside of the pick-up head shown in FIG. 5 clearly displays the pressure shoes 56 and 57 which mutually form parallel and, moreover, horizontally extending strips of pressure when lowered onto the stack 6. The strip of transverse pressure is formed at substantially right angles between these parallel strips by the connecting transverse member 58 against whose edge 62 the projection points 60 rest when in pricking position. The width b of the edge 62 of the member 58 is preferably smaller than the distance between the two pressure shoes 56 and 57. This distance between the pressure shoes may be regulated. The member 58 can be mounted adjustably and movably between the pressure shoes. In this way, as desired, the pick-up heads can be equipped with or without a member 58 depending on whether they are intended for pricking only or also for stretching the top sheet during its separation.

Figure 6:
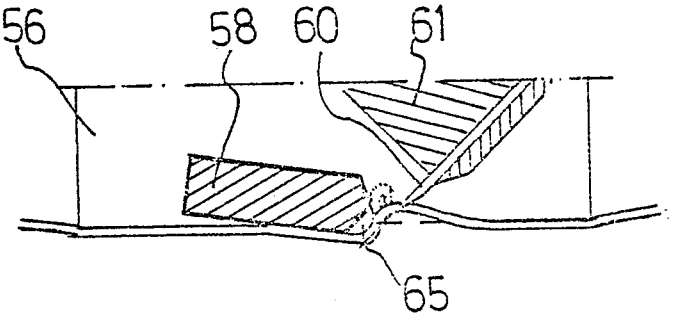
FIG. 6 is an enlarged view of a detail of the position of the pricking element against the stop at the underside of the pick-up head.

In order to protect the projection points 60 against damage and wear when being stopped by the edge 62 of member 58 without a sheet clamped between them, it may be advantageous to provide in the edge 62 suitable slots 65 or holes as shown in FIG. 6 through which the projection points 60 slide when the pricking element is stopped by member 58.

The pick-up head functions as follows: the cross beam 8 with head (heads) 7 is pressed downwards with a pressure of about 40 to 50 kgs per pick-up head. The stack edge compressed by the pressure shoes 56, 57 is lowered about 2 cm, so that the top sheet is substantially at the level of the upper part of the thicker body (shank) of the stack holder 18. The fabric is curved upwards in a convex configuration between the horizontal bases of the shoes 56 and 57 and member 58. Now the pricking elements 61 are obliquely tilted downwards under the impact of pin 63 so that the projections 60 prick obliquely through the convex curve of the uppermost sheet and are stopped by the edge 62 of the member 58 thereby clamping the sheet between them. Owing to the fact that the undersides of the shoes extend horizontally at least over a certain distance (approximately 4 cm), the sheets are kept firmly in position in the pressure zone and the pricking element will not produce any shifting (horizontal dragging along the gripped sheet towards the edge 62) as described in the previous patents of Applicant. The pricking angle will preferably be between 30° and 45° (to the horizontal line) and the projections follow this pricking direction when gripping and clamping the fabric. See FIG. 6. The beam 8 will the pick-up heads 7 is now lifted from the stack 6 and the sheet edge is pulled over the point 47 of the stack holder 18. As soon as suitable removal elements, as for example described in U.S. Pat. No. 4,348,018 have engaged the lifted sheet edge, the pricking elements are retracted under the action of spring 64. The separated sheet is pushed from the projections 60 by the undersides of the pressure shoes 56 and 57.

The pick-up heads can be fixed to the cross beam 8 in an arbitrary position and orientation. If so desired, they can also be applied without making use of stack holders, namely in cases where the fabrics to be processed do not permit any damage through piercing with stack holders (for example in case of smooth and light synthetic fabrics).

The invention is not limited to the aforedescribed embodiments. The supporting platforms 4 and 5 with stacks and stack holders may, for example, also be slid inwards and outwards under the pick-up heads horizontally over guiding rails in the sides of the separating apparatus.

Another variation relates to the manner of piercing the stack. Instead of depositing a full stack against abutment rod 24 on a supporting platform and there to pierce them with stack holders, it is possible for the supporting platform with abutment rod 24 to be used as a stacking device for stacking separate sheets one at a time in which case the stack holders 18 are initially located below the supporting platform with their points 47 substantially on the level of the platform. In this way it is possible (in a known manner) to feed sheet per sheet to this platform and stack them with one edge against the abutment rod 24. In other words, a sheet stack is formed on a platform and as soon as a new sheet has been deposited, the thus formed stack is compressed at the edge near the abutment rod 24. The compression may be analogous to that illustrated in the piercing device in frame 2: the supporting platform is progressively lowered as the stack becomes thicker, whereby the stack holders progressively, prick upwardly from below into the added sheets. However, in this embodiment, the pressure plate is controlled in such a way that, between successive applications of pressure, it is lifted from the stack edge in order to make it possible to feed a new sheet.

This variation of the piercing operation makes it possible for example to restack sheets coming from a first processing unit on the supporting platform with stack holders in the stack edge (whereby the ultimately formed stack is progressively pierced by the entering stack holders). The stacks thus formed on the platform can for example be manually deposited under the pick-up heads by sliding them on guiding rails in the separating apparatus. The stack thus formed on the platform can also be fixed with the frame 2 (as platform 5), if care is taken that the platform and edge bar 13, rack rails 14, transverse bar 10, stack holder clamp 17 and base 11 form a subassembly which can be easily mounted both in frame 2 and in the frame of a stacking device. In this case, the actuation of the jacks and piercing head will be switched off.

It is also possible to locate the piercing device in the lower portion of frame 1. As soon as a stack is removed from platform 4 (and this platform thus is in its uppermost position) the platform 4 with rack rails 14 and stack holders 18 is lowered to the level where base 11 engages the piercing head 9. A stack 6 is laid down on platform 4 and a pressure plate 16 is horizontally introduced between pick-up heads 7 and stack 6. The plate 16 is now pressed downwards onto the stack, which descends against the counteraction of the brake on the free wheel clutch 26. At the same time the stack holder 18 is driven as a bore and progressively penetrates upwards into the descending stack until its point 47 extends above the stack 6. The pressure plate 16 is now removed from frame 1 and platform 4 with pierced stack 6 is lifted until its upper surface reaches the level where the separation of the sheets can start again.

We claim:

1. An apparatus for separating flexible sheets individually from a stack of flexible sheets in successive separating cycles, comprising:

a first frame;

at least one vertically movable pick-up head in said first frame for successively separating said sheets individually from the top of a stack;

means for lowering said at least one pick-up head onto the top of a stack of flexible sheets;

means for removing each separated sheet out of said apparatus;

first and second vertically movable platforms each for supporting a stack;

at least one stack holder adapted to be fitted vertically through at least the entire thickness of a stack;

a second frame;

means in said second frame for piercing a stack with at least one stack holder in at least one place vertically through the entire thickness of the stack and through the top surface of the stack; and, conveyor means circulating into and out of said first and second frames for alternately introducing one of said first and second support platforms with a full stack into said first frame and for subsequently removing the empty support platform out of said first frame;

the other of said support platforms being positioned for cooperation with said piercing means in said second frame while the one of said first and second support platforms is positioned for cooperation with said at least one vertically movable pick-up head in said first frame.

2. An apparatus according to claim 1 and including:

a base for each said stack holder in which said stack holder is rotatably mounted at its bottom end;

a transverse bar associated with each of said support platforms to which each said stack holder base of said support platform is horizontally adjustably connected, said transverse bar being fixed at its ends to said conveyor means;

a stack holder clamp for each said stack holder, each said stack holder extending upwardly from said stack holder base through said stack holder clamp, each said stack holder clamp being horizontally movably mounted to an edge of one of said support platforms;

a horizontally disposed edge bar forming the edge of each of said support platforms to which each said stack holder clamp is mounted; and, vertically disposed rack rails to which each said edge bar is vertically movably mounted, said rack rails associated with each of said support platforms being connected to said conveyor means at the same location as said transverse bar of said support platform.

3. An apparatus according to claim 2 wherein said piercing means comprises:

a piercing head for abuting the bottom end of each said stack holder during piercing of a stack thereby preventing vertical movement of each said stack holder;

a pressure plate for engaging the top of a stack positioned in said second frame while said stack is being pierced; and, jacking means for moving said pressure plate downward to cause the stack and the support platform therebelow to move vertically downward on said rack rails thereby driving each said stack holder vertically through the stack.

4. An apparatus according to claim 1 wherein said piercing means comprises:

a piercing head for abutting the bottom end of each said stack holder during piercing of a stack thereby preventing vertical movemet of each said stack holder;

a pressure plate for engaging the top of a stack positioned in said second frame while said stack is being pierced; and, jacking means for moving said pressure plate downward to cause the stack and the support platform there below to move vertically downward thereby driving each said stack holder vertically through the stack.

5. An apparatus for separating flexible sheets individually from a stack of flexible sheets in successive separating cycles, comprising:

a frame;

at least one vertically movable pick-up head in said frame for successively separating said sheets individually from the top of a stack;

means for lowering said at least one pick-up head onto the top of a stack of flexible sheets;

means for removing each separated sheet out of said apparatus;

a vertically movable platform for supporting a stack;

at least one stack holder adapted to be fitted vertically through at least the entire thickness of a stack; and, means in the lower portion of said frame for piercing a stack with at least one stack holder in at least one place vertically through the entire thickness of the stack and through the top surface of the stack, said piercing means including a piercing head for abutting the bottom end of each said stack holder during piercing of the stack and a pressure plate for engaging the top of the stack in the lower portion of said frame while the stack is being pierced, said pressure plate being slideable in and out of said frame to permit movement of said platform between the lower portion of said frame and a position for cooperation with said at least one vertically movable pick-up head.

6. An apparatus according to claim 1 wherein each said pick-up head comprises:

two spaced parallel pressure shoes; and, a pricking element between said parallel pressure shoes rotatable about a horizontal shaft, said pricking element having a number of projections positioned on the base thereof;

at least one of said pick-up heads also including a transverse member connecting said parallel pressure shoes at their bases, said transverse member having an edge which is positioned so as to function as a stop for the projections of said pricking element when said pricking element is rotated into the pricking position.

7. An apparatus according to claim 6 wherein said edge of said transverse member is lower than the bases of said parallel pressure shoes.

8. An apparatus according to claim 7 wherein the width of said edge of said transverse member is smaller than the spacing between said parallel pressure shoes.

9. An apparatus according to claim 8 wherein said transverse member includes slots in said edge.

10. A process for separating flexible textile sheets individually from at least one stack of flexible sheets in successive separating cycles, comprising:

compressing each of said stacks;

piercing each said stack in at least one place with a stack holder vertically through the entire thickness of said stack and through the top surface of said stack while said stack is under compression and creating thereby at least one hole through said stack, each said stack holder being thereby fitted in each said hole extending through at least the entire thickness of said stack; and, subsequently successively separating the sheets individually from the top of each said stack by engaging each top sheet from above each said stack, lifting at least the limited area of each said top sheet adjacent each said stack holder vertically upwardly off the upper end of each said stack holder to separate each said limited area from the top of each said stack, and thereupon separating each said top sheet in its entirety from the top of each said stack.

11. A process according to claim 10 and including piercing each said stack on a supporting platform to which each said stack holder is connected.

12. A process according to claim 10 and including, subsequent to said piercing of each said stack with each said stack holder, moving each said stack to another location for said sheet separating step and subsequently removing each said stack holder from said separating location.

13. A process according to claim 12 and including piercing each said stack on a supporting platform to which each said stack holder is connected and, after said separating of said sheets, removing each said supporting platform with each said connected stack holder from said separating location.

14. A process for separating flexible sheets individually from at least one stack of flexible sheets in successive separating cycles, comprising:

compressing each of said stacks;

piercing each said stack in at least one place with a stack holder vertically through the entire thickness of said stack and through the top surface of said stack while under compression to form at least one hole therethrough with a stack holder fitted in each said hole extending through at least the entire thickness of said stack, said piercing of each said stack occurring under means for separating said sheets individually from said stack, each said stack being pierced on a supporting platform to which each said stack holder is connected;

subsequently successively separating said sheets individually from the top of each said stack wherein each top sheet is lifted off the upper end of each said stack holder by engaging each said top sheet from above said stack with said separating means whereby each said top sheet in at least one limited area of the surface thereof is separated from the top of said stack; and, removing each said supporting platform from said separating means for said separating of said sheets.

15. A process for separating flexible sheets individually from at least one stack of flexible sheets in successive separating cycles, comprising:

compressing each of said stacks;

piercing each said stack in at least one place with a stack holder vertically through the entire thickness of said stack and through the top surface of said stack while under compression to form at least one hole therethrough with a stack holder fitted in each said hole extending through at least the entire thickness of said stack; and, subsequently successively separating said sheets individually from the top of each said stack wherein each top sheet is lifted off the upper end of each said stack holder by engaging each said top sheet from above said stack with separating means whereby each said top sheet in at least one limited area of the surface thereof is separated from the top of said stack;

said separating of said sheets from a stack comprising applying pressure with said separating means to two adjacent substantially parallel strips of the surface of said top sheet thereby to compress said stack in these areas, subsequently obliquely pricking a number of sharp projections of said separating means of predetermined projection length into said top sheet between the parallel strips to engage said top sheet, and lifting said top sheet in the area of said pressure application from said stack by means of said separating means thereby ceasing said application of pressure.

16. A process according to claim 15 wherein said separating means includes spaced pick-up heads coacting in pairs and said process includes tensioning slightly said top sheet between said pick-up heads as said top sheet is lifted and said application of pressure ceases.

17. A process according to claim 15 and including pressing the pricked top sheet against a stop member on said separating means by means of said number of sharp projections prior to lifting said top sheet.

18. A process according to claim 17 and including applying pressure by means of said stop member to a transverse strip of the surface of said top sheet extending at substantially a right angle between said two adjacent substantially parallel strips of said top sheet, said application of pressure to the transverse strip beginning slightly sooner than said application of pressure to said two adjacent substantially parallel strips.

* * * * *